US008395093B1

(12) United States Patent
Auffinger, III et al.

(10) Patent No.: US 8,395,093 B1
(45) Date of Patent: Mar. 12, 2013

(54) CONDUCTIVE ELASTOMERIC HEATER WITH EXPANDABLE CORE

(75) Inventors: Frank Auffinger, III, Hamilton, OH (US); Michael Richard Maddux, Jamestown, OH (US); Kristopher Karl Aber, Cincinnati, OH (US); Brandon Charles Kirby, Morgantown, WV (US)

(73) Assignee: Cornerstone Research Group, Inc., Dayton, OH (US)

( * ) Notice: Subject to any disclaimer, the term of this patent is extended or adjusted under 35 U.S.C. 154(b) by 478 days.

(21) Appl. No.: 12/754,708

(22) Filed: Apr. 6, 2010

(51) Int. Cl.
*H05B 3/16* (2006.01)
*H05B 3/34* (2006.01)

(52) U.S. Cl. ..... 219/543; 219/546; 219/549

(58) Field of Classification Search ..... 219/543, 219/546–549
See application file for complete search history.

(56) References Cited

U.S. PATENT DOCUMENTS

| | | | | |
|---|---|---|---|---|
| 3,152,313 | A | 10/1964 | Barbour et al. | |
| 4,657,807 | A | 4/1987 | Fuerstman | |
| 4,764,665 | A | 8/1988 | Orban et al. | |
| 4,831,094 | A | 5/1989 | Stein et al. | |
| 4,892,626 | A | 1/1990 | Covey | |
| 5,089,325 | A | 2/1992 | Covey | |
| 5,573,687 | A * | 11/1996 | Tanaka | 219/213 |
| 5,714,738 | A | 2/1998 | Hauschulz et al. | |
| 6,316,084 | B1 | 11/2001 | Claus et al. | |
| 6,486,447 | B2 * | 11/2002 | Miyata | 219/444.1 |
| 6,759,481 | B2 | 7/2004 | Tong | |
| 7,078,658 | B2 | 7/2006 | Brunner et al. | |
| 2004/0035854 | A1 * | 2/2004 | Cheng et al. | 219/549 |

FOREIGN PATENT DOCUMENTS

WO 2005108448 11/2005

OTHER PUBLICATIONS

U.S. Appl. No. 11/496,352, Hemmelgarm et al.

* cited by examiner

*Primary Examiner* — Hung Vu
(74) *Attorney, Agent, or Firm* — Dinsmore & Shohl LLP

(57) ABSTRACT

The preferred embodiment utilizes metal coated high strain fabric reinforcement including but not limited to fiberglass, cotton fiber, or other materials that can undergo deformation, and various resin or elastomer compounds to create a conductive polymer whose resistivity and resistance remain essentially constant under a strain of approximately 0-150% or more. Additionally, the preferred embodiment utilizes a method of imprinting, depositing, etching, or embossing a design or pattern of conductive metal on fabric used in composites. The use of designs of conductive metals wrapped around a deformable core and the unique features of elastomeric polymers allows for their use as a flexible circuit board, formable heaters, and other various uses.

28 Claims, 6 Drawing Sheets

CONDUCTIVE ELASTOMERIC HEATER WITH EXPANDABLE CORE

STATEMENT REGARDING FEDERALLY SPONSORED RESEARCH OR DEVELOPMENT

This invention was made with U.S. Government support under contract FA8651-04-C-0133 awarded by the Department of the Air Force, Air Armament Center and contract NNM08AA05C awarded by National Aeronautics and Space Administration. The U.S. Government has certain rights in the invention.

BACKGROUND OF THE DISCOVERY

1. Field of the Discovery

The field of the presently disclosed apparatus relates to filling a void's volume with a conformal heater. More specifically the apparatus relates to the use of conductive linings or imprints surrounding a conformal core to fill the void's volume and/or impart heat energy to a void's walls through more efficient conduction and heat transfer. The conformal core will need to impart force that maintains the surface contact between the heater and material wall.

2. Description of Related Art

The terms "elastic" and "elastomeric" are used herein to mean any material which, upon application of a biasing force, is stretchable, to a stretched, biased length which is at least about ten percent (10%) longer than its relaxed unbiased length, and which, will recover at least fifty percent (50%) of its elongation upon release of the stretching, elongating force. A hypothetical example would be a one inch sample of a material which is stretched to at least 1.10 inches and which, upon being elongated to 1.10 inches and released, will recover to a length of not more than 1.05 inches. Many elastic materials may be elongated by much more than ten percent (10%) (i.e., much more than one hundred ten percent (110%) of their relaxed length), for example, elongated by two hundred percent (200%) or more, and many of these will recover to substantially their initial relaxed length, for example, to within one hundred one percent (101%) of their initial relaxed length, upon release of the stretching force.

The term composite is commonly used in the industry to identify components produced by impregnating and/or encapsulation a filler material, often comprised of particles or fibers, with a resin material. Examples of fillers include, but are not limited to cloth fabrics, carbon nanotubes and carbon nanofibers, metallic fabrics and particles, wood fibers and particles, and other similar fabrics, fibers, and particles. Generally, polymers and polymer composites have the advantages of weight saving, high specific mechanical properties, and good corrosion resistance which make them indispensable materials in all areas of manufacturing. Nevertheless, manufacturing costs are sometimes detrimental, since they can represent a considerable part of the total costs and are made even more costly by the inability to quickly and easily repair these materials without requiring a complete, and expensive, total replacement. Furthermore, the production of complex shaped parts is still a challenge for the composite industry. The limited potential for complex shape forming offered by advanced composite materials leaves little scope for design freedom in order to improve mechanical performance and/or integrate supplementary functions. This has been one of the primary limitations for a wider use of advanced composites in cost-sensitive large volume applications.

Shape memory polymers (SMPs) and shape memory alloys (SMAS) were first developed about twenty (20) years ago and have been the subject of commercial development in the last ten (10) years. SMPs are polymers that derive their name from their inherent ability to return to their original "memorized" shape after undergoing a shape deformation.

SMPs have a dynamic modulus that undergoes a sharp change in the modulus of elasticity at its glass transition temperature ($T_g$). This sharp change facilitates easy molding and forming of SMPs or composites wherein the resin used in the composite is an SMP. SMPs which have been preformed can be deformed to any desired shape below or above its $T_g$. If the SMP is below the $T_g$, this process is called cold deformation. When deformation of the SMP occurs above its $T_g$, the process is denoted as warm deformation. In either case the SMP must remain below, or be quenched to below, the $T_g$ while maintained in the desired deformed shape to "lock" in the deformation. Once the deformation is locked in, the polymer network cannot return to a relaxed state due to thermal barriers. The SMP will hold its deformed shape indefinitely until it is heated above its $T_g$, whereupon the strain energy, stored as potential energy in the SMP, is released and the SMP returns to its preformed state. Typically, SMPs are deformed above their $T_g$ because of the ease of deforming the SMP at these temperatures versus deforming the SMP at temperatures below their $T_g$. Additionally, SMPs have can have a higher strain imparted on the SMP before failure if deformed above their $T_g$.

SMPs are not simply elastomers nor simply plastics. They exhibit characteristics of both materials, depending on their temperature. While rigid, and below its $T_g$, an SMP demonstrates the strength-to-weight ratio of a rigid polymer; however, normal rigid polymers under thermal stimulus simply flow or melt into a random new shape, and they have no "memorized" shape to which they can return. While heated and pliable, above its $T_g$, an SMP has the flexibility of a high-quality, dynamic elastomer, typically tolerating four hundred percent (400%) elongation or more; however, unlike normal elastomers, an SMP can be reshaped or returned quickly to its memorized shape and subsequently cooled into a rigid plastic. If deformed or reshaped above its $T_g$ and this deformation is maintained while the SMP is cooled, the SMP will retain this new, deformed, shape while below its $T_g$. If the SMP is then reheated to above its $T_g$ the SMP, without additional force, will return to its original memorized shape.

Several known polymer types exhibit shape memory properties. Probably the best known and best researched polymer types exhibiting shape memory polymer properties are polyurethane polymers. Other SMP polymers known in the art include articles formed of Norborne or dimethaneoctahydronapthalene homopolymers or copolymers, set forth in U.S. Pat. No. 4,831,094. Additionally, styrene copolymer based SMPs are disclosed in U.S. Pat. No. 6,759,481 and Shape Memory Cyanate Ester Copolymers are disclosed in PCT application WO/2005/108448 published Nov. 17, 2005, which are incorporated herein by reference.

The primary design components of thermally activated SMPs include at least one monomer, possibly a co-monomer, a crosslinker, and possibly an initiator and additional filler material. A polymer engineered with shape memory characteristics provide a unique set of material qualities and capabilities that enhance traits inherent in the polymer system. SMPs can be chemically formulated with a transition temperature to match most application needs. It can be cast and cured into an enormous variety of "memorized" shapes, from thick sheets and concave dishes to tiny parts or a complicated open honeycomb matrix.

Methods other than thermal energy can activate the shape memory properties of SMP. Electromagnetic radiation, UV light and magnetism can be used to activate the SMP. Throughout this application "activation" will be defined as transitioning the material from a hard, rigid state to a soft, pliable and elastic state. Additionally, throughout this application, "deactivation" will be defined as transitioning the material from a soft, pliable state to a hard, rigid state.

Sheets of conductive metalized fabrics are well known in the art. In one method for introducing metal into the fabric of a composite, metal threads are woven into the graphite fabric at regular intervals. While this prior art technique has been proven satisfactory for most cases, it is evident that due to the inability of a metal thread to stretch, any strain is likely to break some, if not all, of the metal threads, reducing the conductivity of the composite.

In a second prior art technique for introducing metal into a composite, each fiber of the outermost layer is coated with metal prior to being woven into a continuous sheet. This technique is particularly disadvantageous in that the coaxial metal sheath around each fiber has a substantially different modulus of elasticity than the fiber itself. Thus, when the composite is subject to bending moments, the metal sheath tends to shear away from the fiber. In addition, unnecessary excess weight is introduced into the fabric weave.

A third prior art technique for introducing metal into a composite is shown by EEONYX Corporation (www.eeonyx.com). They created a intrinsically conductive polymer (ICP) with a chemical composition of polyaniline or polypyrrole. Those ICPs can only be added to plastics with a lower melting point of up to two hundred degrees Celsius (200° C.), and are therefore very limited in their use. The ICP can be prepared and deposited into a carbon black or other matrix and increase the use of plastics with three hundred degree Celsius (300° C.) melting point. The use of ICPs improves the electrical, mechanical and melt flow properties and greatly reduces the compounding difficulties and easier end-product fabrication of composites. In certain applications, the plastic exhibits a ten-fold increase in conductivity compared to high structure carbon black loaded alloys at the same loading level.

U.S. Pat. No. 4,657,807 issued to Myron M. Fuerstman on Apr. 14, 1987, discloses a method of depositing metal onto fabrics such as cotton and polyester. The process used according to Fuerstman was to select a fabric capable of flattening or polishing under heat and pressure, pressing the fabric against a heated surface and then vacuum metalizing the fabric by vapor deposition.

U.S. Pat. No. 4,764,665 issued to Ralph Orban, et. al, on Aug. 16, 1988 discloses several uses of a metalized conductive fabric. Specifically, Orban discloses use of the metalized fabric as a resistive heating element for use on airplane wings and in clothing, specifically gloves. The gloves are electrically heated woven fabric in which the fabric has been coated with electrically conducting metal to enable its use as a heating element. The fabric is in the shape of a hand.

U.S. Pat. No. 5,089,325, issued on Feb. 18, 1992, and U.S. Pat. No. 4,892,626 issued on Jan. 9, 1990, to James Covey discloses methods for plating one side of a woven fabric sheet by using a backing layer applied to one side of the sheet. The sheet and backing layer are wetted in an electrolytic solution containing metallic ions to be deposited on one side of the fabric sheet only. Air bubbles trapped in interstices of the fabric weave and beneath the backing sheet prevent the electrolytic solution from soaking through the fabric sheet. Electrodes bond the metal ions on the wetted fabric thereto. The backing sheet is then removed. The resulting fabric is coated on only one side and the interstices are not filled in by plating material. The fabric is useful as the outermost layer in a composite laminate for an aircraft skin.

Additionally, U.S. Pat. No. 7,078,658 issued to Daniel Brunner and André Amari on Jul. 18, 2006 discloses a method for using conductive fibers as a heater mat for aircraft. The heater mat is provided with a resistive element including at least two substantially parallel segments of electrically conductive fibers disposed on the aerodynamic surface of an aircraft. The segments come from a single strip of electrically conductive fibers, with two adjacent segments being obtained by folding a portion of the single strip at least twice. However, similarly to the previously discussed methods, Brunner fails to disclose a method of creating conductive patterns on a piece of fabric for use in a composite and limits the composite to those containing carbon fibers.

The drawbacks of the present methods, including the imprinting of a design onto a fabric by pressing metal foil which is well known in the art, include the inability to selectively deposit the material onto a particular portion of the fabric. Orban, while showing the ability to cut a piece of conducting fabric into a predetermined shape, does not disclose or show a means for selectively depositing metal onto only a predetermined portion of a single side or both sides of a piece of fabric. Similarly Fuerstman does not disclose a means to selectively deposit metal in a predetermined shape or pattern onto a fabric. Finally, both patents issued to Covey only disclose a means for depositing metal onto a single side and does not disclose how to imprint or deposit metal onto a fabric in a predetermined shape or pattern.

The two principal methods of creating high-strain conductive elastomers focus on developing the elastomer at the nano scale or involve the addition of conductive nano-sized fillers including: carbon nano-fibers/tubes, carbon black, nickel nano-strands, nickel coated graphite particles, and other nano-sized conductors.

The first major effort to create conductive elastomers, polymers and polymer composites was through the use of fillers. These processes use nano-sized conductive additives to increase the conductivity of elastomers, polymers, and polymer composites. High percent loadings of fillers, ten percent (10%) or more, are required to achieve useful electrical conductivity, resulting in a large decrease in the maximum percent elongation and ultimate tensile strength of the base elastomer. The electrical resistance of these materials also increased significantly with percent strain, rendering circuit design with these materials essentially impossible. The use of small, nano-sized carbon tubes, or other conducting material, as filler, to create a conductive elastomer, polymer and polymer composite is well known in the prior art.

One example of the use of fillers to create a conductive elastomer involves tailoring the electrical conductivity in elastomeric and polymeric materials used to build military and commercial aerospace components, with negligible impact on the elastomer's mechanical properties or manufacturing ability. This technology transforms almost any common elastomer or polymer into a multifunctional material capable of carrying or dissipating a significant electrical charge, an advancement offering tremendous promise throughout the space, aerospace, automotive, and chemical industries. This is controlled by dispersion of specifically designed, highly electrically conductive, yet remarkably flexible, carbon nano-tubes into the supporting elastomer or polymer matrix. These nano-tubes have the current carrying capacity of copper but with a comparatively much lower density.

The nano-tubes used in the finished products are on the order of sixty to two hundred nanometers in diameter with an aspect ratio (the ratio of their length to their diameter) of greater than eight hundred. The electrical and thermal conductivity of these nano-tubes is highly dependent on the architecture and design of the nano-tubes. This high aspect ratio results in a much lower required filler content to achieve percolation (onset of conductivity) than traditional metal-filled systems. The percolation threshold for these materials is less than one half of one percent by volume. The multi-wall nano-tubes used in this process are available in ton quantities, which allow affordable, realistic scale-up of the resultant nano-composites. Other examples of use of nano-tubes of conducting material are well known in the art.

The principle disadvantages of this method are the difficulty in achieving and maintaining the proper alignment of nano-tubes in the resin/elastomer matrix to ensure good conductivity. The specific environmental conditions and special equipment needed make these production methods very expensive. Additionally, as described in Effect of Strain on the Properties of an Ethylene-Octene Elastomer with Conductive Carbon Fibers, L. Flandin, et. al., Journal of Applied Polymer Science, 2000; 76 (6): 894-905, 897; Practical Considerations for Loading Conductive Fillers into Shielding Elastomers, Brian W. Callen and James Mah, ITEM 2002, 130-137, 134; and Interrelationships Between Electrical And Mechanical Properties Of A Carbon Black-Filled Ethylene-Octene Elastomer, L. Flandin, A. Hiltner, E. Baer, Polymer, January 2001 827-838, 831; the resistance of these materials likely dramatically increases under strain and the maximum strain decreases as the percentage of nano-tubes increase.

Because of the loading requirements and the size of the tubes it would be nearly impossible to imprint electrical circuit designs onto this type of composite as the scale of the conductive elements is not easily manipulated.

The second major area of investigation involved the manufacture of conductive polymers on the nano-scale. The process typically involved manipulating molecules to achieve a desired set of material characteristics by allowing only some molecules to bond to particular sites.

One of the latest attempts at solving the problem on the nano-scale involves NanoSonic, Inc.'s process to produce what it calls Metal Rubber™ U.S. Pat. No. 6,316,084 issued Nov. 13, 2001 to Richard O. Claus and Yanjing Liu covers some of NanoSonic's technology. According to Claus and Liu the material can be stretched to about three hundred percent (300%) of its original length and relax back. It can be exposed to chemicals, boiled in water overnight, and it doesn't mechanically or chemically degrade. Additionally it can be heated to approximately three hundred seventy degrees Celsius (370° C.), and it maintains its properties.

Metal Rubber™ is made using a nanotechnology process call electrostatic molecular self-assembly which means that Metal Rubber™ is formed one layer at a time where individual molecules are formed layer by layer on a surface. Starting with a plastic or glass substrate, or base, that is given an electric charge, either positive or negative, the plate is dipped alternately into two water-based solutions, one containing plastic molecules that have been given a positive electrical charge and the other containing plastic molecules with a negative charge. If the base has a positive charge, it goes into the negative molecules first, and they cling to the base, forming a layer only one molecule thick. After the next dipping, into positive molecules, a second ultra thin layer forms and this process will continue until the completed product is formed.

The biggest challenge to accurate and mass production is that the process requires the layers to be built one molecule layer thick at a time, which is very time consuming. Another difficulty is that the fabric size capable of being produced is limited to the plate size and is not readily capable of mass production. The added expense of chemicals, cleaning, and the low production rate makes the product very expensive. Finally, it is even more difficult and time consuming to produce a pattern of conductive metal on a fabric using this method.

U.S. Pat. No. 3,152,313, issued Oct. 6, 1964 to Barbour et al., discloses an elastic heater comprising of a wire heating element attached to an elastic cloth. The wire heating element is bent in a zigzag shape to allow the wire to straighten out with the stretching of the elastic cloth and return to a zigzag shape when the elastic cloth returns to its resting state. This disclosure is limited in stretch by the straight length of the heating wire in the stretched state. Further wire fatigue will become an issue over repeated use. This disclosure is used to cover an outer surface and not to cover an inner surface of a void.

U.S. Pat. No. 5,714,738 issued Feb. 3, 1998 to Hauschulz et al., discloses a heater mat that is preferably made of two layers of fiberglass reinforced rubber sheets laminated together with resistive heater wires sandwiched between the laminated sheets. The heater mat is formed with a curvature and size to fit snugly around the peripheral surface of the pipe that is to be heated. A jacket of thermally insulative material, such as a polymer foam, is molded over the external surface of the heater mat. The mat and the jacket are configured so that the heater has interfacing opposite edges that meet and preferably touch each other when the heater is mounted onto the pipe, but the combination of the mat and jacket have sufficient resilient flexibility to allow opening the heater by separating the edges enough to slip the heater over the pipe, whereupon the heater resumes its original inherent cylindrical shape when released. Snaps, Velcro™ fastening material straps, or other suitable fasteners can be used to secure the heaters snugly around the pipe, if desired, although the biased resilience of the heater to its formed shape is generally sufficient itself to hold the heater in place. The disclosure uses resistive heaters, has a fixed shape defined by a mold, and is only flexible enough to snap around an object.

SUMMARY OF THE DISCOVERY

It is an object of the preferred embodiment to provide for a composite with an embedded design of conductive material imprinted, deposited, etched, stamped, or embossed on a deformable core. Another embodiment is a piece of fabric with an embedded design of conductive material imprinted, deposited, etched, stamped, or embossed on the fabric with that fabric optionally being placed in a resin matrix, creating a composite that is wrapped around a deformable core to enable the composite to conform to the shape of a void. Using a composite is not required, layered materials could suffice in some situations. Deformation is important, elongation is not. The core could even be a hinged or engineered mechanism that maintains the surface shape as desired. The design should consider what materials will be used and how the system will interface.

In another embodiment the composite materials presented herein provide a unique capability of achieving strains up to or exceeding one hundred percent (100%) while maintaining essentially a near constant electrical resistance and resistivity. This capability coupled with a deformable core makes this embodiment ideal for heating a surface.

There is a need for a means to create conductive patterns and designs in a composite. There is also a need for those conductive composites to conform to the shape of a void to directly transfer heat energy to the walls. Both of these needs are met by the current embodiment.

DETAILED DESCRIPTION OF THE DRAWINGS

DETAILED DESCRIPTION OF EXEMPLARY EMBODIMENTS

Figure 1:
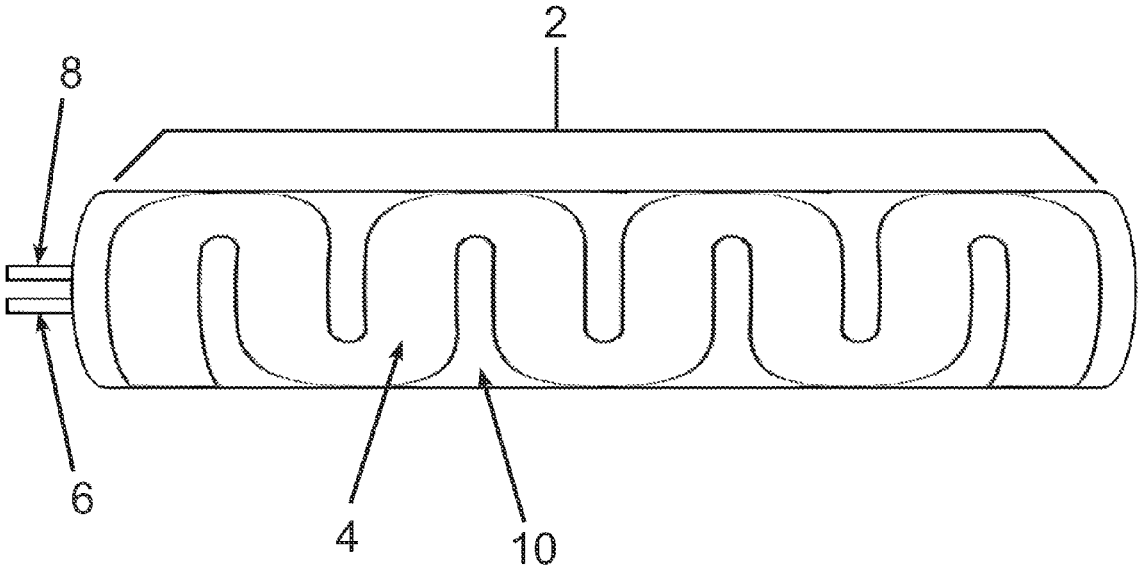
FIG. 1 shows a perspective view of the conductive material pattern on a conformal heater.

The preferred embodiment utilizes metal coated high strain fabric reinforcement including but not limited to stretchy fabrics defined as any fabric capable of undergoing a strain of at least twenty percent and recovering to at within at least ten percent of its original shape, cotton fiber, or other material that can undergo high strain, and various resin or elastomer compounds to create a conductive polymer or elastomer whose resistivity is between 0.01 and 10 Ω·cm and whose resistivity and resistance remain essentially constant under a strain of approximately 0-150%, or more. Additionally, the use of shape memory polymers (SMPs) as the matrix resin allows for the composite to undergo strain and recover its shape. Shape memory polymer or elastomer can be made as a styrene shape memory polymer or elastomer, cyanate ester shape memory polymer or elastomer, maleimide shape memory polymer or elastomer, epoxy shape memory polymer or elastomer, acrylate shape memory polymer or elastomer, polyurethane shape memory polymer or elastomer, or vinyl ester shape memory polymer or elastomer. The conformal core will need to impart force that maintains the surface contact between the heater and material wall.

Deformable as used throughout this application means that a material can be deformed in any manner, including, but not limited to, bending, stretching, and compressing and after the forces deforming the material are removed, the material will recover to at least 50% of its original shape or that the forces from the release of stored energy can also enable recovery to original or other configurations in some circumstances.

Elastomers, polymers and polymer composites are essentially non-conductive materials that are used extensively in manufacturing because of their low weight, high strength, and inexpensive production costs. An inexpensive, conductive elastomer and polymer has been the object of many research attempts. Most of these attempts involve using filler, normally a conductive material, such as carbon nano-fibers or conductive wires embedded or mixed in with the polymer resin to obtain a conductive elastomer or polymer. These filler materials allow the elastomer or polymer to conduct electricity. A more recent attempt to solve this problem involves long, costly processes to "self assemble" the conductive elastomer or polymer one molecule thick layer at a time as discussed above. It will be apparent to one skilled in the art that various methods of making these conductive elastomers or polymers and composites exists, however, the ability to maintain constant electrical and mechanical properties under strain is still a challenge in the industry.

The electrical resistance of a wire is normally expected to be greater for a longer wire or conductor, less for a wire or conductor of a larger cross sectional area, and would be expected to depend upon the material out of which the wire is made. Resistivity is a bulk property of material describing how well that material inhibits current flow. This is slightly different from resistance, which is not a physical property. Experimentally, the dependence upon these properties is a straightforward one for a wide range of conditions, and the resistance of a conductor can be simply expressed as: $R=(\rho*L)/A$ where R is the resistance as measured in Ohms ("Ω"), ρ is the resistivity of the material (typically measured in Ω·cm or Ω·m), L is the length of the material, and A is the cross sectional area of the material.

The factor in the resistance which takes into account the nature of the material is the resistivity. Although resistivity is temperature dependent, it can be used at a given temperature to calculate the resistance of a wire of given geometry.

In some cases conductivity, the inverse of resistivity is the principally discussed property. There are contexts where the use of conductivity is more convenient and it will be noted that that as resistivity decreases, conductivity increases as shown by: Electrical conductivity=$\sigma=1/\rho$. Thus, a low resistivity indicates a material that readily allows the movement of electrons and electricity, giving a high value of conductivity. It should also be noted that generally a low resistivity and high conductivity are very desirable.

Generally elastomers, polymers and polymer composites have the advantages of weight saving, high specific mechanical properties, and good corrosion resistance which make them indispensable materials in all areas of manufacturing. SMPs have similar properties which have been known for approximately twenty years with the added advantage of retaining certain shapes, in memory, that can be recovered upon activation of the shape memory polymer. The preferred embodiment takes advantage of the physical properties of these elastomers, resins, polymer composites and stretchy fabric to create a conductive elastomer or polymer composite that maintains a constant resistance under strain.

In another embodiment the deformable core has conductive strips, wires, bands, ribbons, or other similar material imprinted, deposited, etched, stamped, or embossed directly on the deformable core.

First introduced in the United States in 1984, SMPs are polymers whose qualities have been altered to give them dynamic shape "memory" properties. Activation can occur under thermal, chemical, electromagnetic radiation, water, and other stimuli depending on the type of SMP desired for a particular use. SMPs can exhibit a radical change from a rigid plastic to a highly flexible, elastic state, and then return again to a rigid state. In its elastic state, the SMP will recover and hold its "memory shape" if left unrestrained. The "memory shape" is the shape defined by the mold in which the SMP was cured. In its elastic state, the SMP may be changed to a "deformed shape". The "deformed shape" is any shape other than its "memory shape". The "memory effect" or recovery quality comes from the stored potential energy or strain energy attained during the deformation of the material. SMPs ability to change modulus and shape configuration at will makes SMPs ideal for applications requiring lightweight, dynamic, and adaptable materials.

The ability of SMPs to hold a deformed shape and their ability to return to a memory shape are dependant on a threshold condition. SMPs are activated by any number of various mechanisms which will depend on the type of shape memory polymer used. As used throughout this application to activate or activation of a SMP means to make it soft, pliable such that it is easily manipulated. SMPs may be activated by any number of various mechanisms, including, but not limited to, temperature, electromagnetic radiation, water, chemicals and other similar means. As used throughout this application to deactivate or deactivation of a SMP means to make it hard and rigid. SMPs may be deactivated by any number of various mechanisms, including, but not limited to temperature, electromagnetic radiation, water, chemicals and other similar means. The activation and deactivation mechanisms are preferred to be the same for every SMP, but may be different depending on the design requirements.

A common type of SMP is a thermally activated SMP. A thermally activated SMP has a threshold temperature that defines activation or deactivation of the SMP. That threshold temperature is called the glass transition temperature ($T_g$) and is defined by the chemical composition of the SMP. Thermal activation is accomplished by heating the SMP above its $T_g$. The SMP is deactivated by cooling the SMP below its $T_g$.

There are typically two types of resins used in the SMP industry, thermoset resins and thermoplastic resins. Thermoset resins, for example polyesters, are liquids that react with a catalyst to form a solid, and cannot be returned to their liquid state. Thermoplastics resins, for example polyvinyl chloride (PVC), are also liquids that become solids. But unlike thermoset resins, thermoplastics are softened by the application of heat or other catalysts. Thermoplastics that are above their $T_g$ but below their melting temperature exhibit rubber-like characteristics and can exhibit large elongations under relatively low load. Thermoplastics further can be heated, reshaped, heated, and reshaped repeatedly.

SMPs used in the presently disclosed device are unique thermoset polymers, which, unlike conventional thermoset polymers, can be reshaped and reformed repeatedly because of their dynamic modulus. These polymers combine the most useful properties of thermoplastic polymers with those of a thermoset polymer enabling designers to utilize the beneficial properties of both thermoset and thermoplastic resins while eliminating or reducing the unwanted properties. Such polymers are described in U.S. Pat. No. 6,759,481 issued to Tong, on Jul. 6, 2004 with other thermoset resins seen in PCT Application No. PCT/US2006/062179, filed by Tong, et al on Dec. 15, 2006; and PCT Application No. PCT/US2005/015685 filed by Tong et al, on May 5, 2005 all of which are hereby incorporated by reference.

The preferred embodiment allows for the etching, embedding, or imprinting of designs onto cotton fiber, stretchy fabric herein defined as any fabric that can be stretched in any direction by any amount, fiberglass, and other fibrous materials typically used in composites, such that only those portions of the material will be conductive. This allows for the etching of electrically conductive designs including circuits, circuit traces, heating elements, and other designs which are desirous of being conductive. In the preferred embodiment, by depositing certain conductive metals onto the stretchy fabric in a predetermined pattern, a design can be etched onto a stretchy fabric. This process allows for the controlled etching of these patterns onto stretchy fabric and other fabric.

Under the preferred embodiment, the resistance of a material under strain remains essentially constant and is accomplished in the manner disclosed. By maintaining an essentially constant resistance under strain, the preferred embodiment allows for a smaller power supply to be used to operate the embodiment. Additionally, the exponentially increasing resistance that is normally seen in composites requires careful planning and limits the amount of strain that can be placed on a composite. This essentially constant resistance experienced by the preferred embodiment was unexpected and eliminated the need for planning which limits or eliminates the possibility for the composites to undergo strain.

TABLE 1

| Cycle 1 | | Cycle 2 | | Cycle 3 | | Cycle 4 | | Cycle 5 | |
|---|---|---|---|---|---|---|---|---|---|
| $\epsilon'$ (%) | Resistance (Ω) | $\epsilon'$ (%) | Resistance (Ω) | $\epsilon'$ (%) | Resistance (Ω) | $\epsilon'$ (%) | Resistance (Ω) | $\epsilon'$ (%) | Resistance (Ω) |
| 0 | 0.6 | 0 | 0.6 | 0 | 0.6 | 0 | 0.6 | 0 | 0.6 |
| 10 | 0.6 | 10 | 0.6 | 10 | 0.6 | 10 | 0.5 | 10 | 0.6 |
| 20 | 0.6 | 20 | 0.6 | 20 | 0.5 | 20 | 0.5 | 20 | 0.5 |
| 30 | 0.6 | 30 | 0.6 | 30 | 0.5 | 30 | 0.5 | 30 | 0.5 |
| 40 | 0.6 | 40 | 0.5 | 40 | 0.5 | 40 | 0.5 | 40 | 0.5 |
| 50 | 0.6 | 50 | 0.5 | 50 | 0.5 | 50 | 0.5 | 50 | 0.5 |
| 60 | 0.6 | 60 | 0.6 | 60 | 0.6 | 60 | 0.5 | 60 | 0.5 |
| 70 | 0.7 | 70 | 0.6 | 70 | 0.5 | 70 | 0.5 | 70 | 0.5 |
| 80 | 0.6 | 80 | 0.6 | 80 | 0.5 | 80 | 0.5 | 80 | 0.5 |
| 90 | 0.7 | 90 | 0.6 | 90 | 0.5 | 90 | 0.5 | 90 | 0.5 |
| 100 | 0.7 | 100 | 0.6 | 100 | 0.5 | 100 | 0.5 | 100 | 0.6 |
| 90 | 0.6 | 90 | 0.6 | 90 | 0.5 | 90 | 0.6 | 90 | 0.6 |
| 80 | 0.6 | 80 | 0.6 | 80 | 0.5 | 80 | 0.5 | 80 | 0.5 |
| 70 | 0.6 | 70 | 0.6 | 70 | 0.5 | 70 | 0.5 | 70 | 0.5 |
| 60 | 0.6 | 60 | 0.5 | 60 | 0.5 | 60 | 0.5 | 60 | 0.5 |
| 50 | 0.6 | 50 | 0.6 | 50 | 0.5 | 50 | 0.6 | 50 | 0.5 |
| 40 | 0.6 | 40 | 0.6 | 40 | 0.6 | 40 | 0.5 | 40 | 0.5 |
| 30 | 0.6 | 30 | 0.6 | 30 | 0.6 | 30 | 0.5 | 30 | 0.6 |
| 20 | 0.6 | 20 | 0.6 | 20 | 0.5 | 20 | 0.5 | 20 | 0.6 |
| 10 | 0.6 | 10 | 0.6 | 10 | 0.6 | 10 | 0.5 | 10 | 0.6 |
| 0 | 0.6 | 0 | 0.6 | 0 | 0.6 | 0 | 0.6 | 0 | 0.6 |

Table 1 above shows how the resistance of a sample of conductive stretchy fabric was exposed to a strain of 0% to 100% and back. As can be seen from the results in Table 1, the material experience less than a 15% increase in resistance over 5 cycles of the material, reaching its peak resistance at 100% strain in the first cycle.

TABLE 2

| | Resistance (Ω) | | | | |
|---|---|---|---|---|---|
| $\epsilon'$ (in/in) | Sample 1 | Sample 2 | Sample 3 | Sample 4 | Sample 5 |
| 0 | 1.9 | 2 | 1.8 | 2.1 | 2.5 |
| 0.1 | 1.9 | 1.9 | 1.8 | 2.2 | 2.2 |
| 0.2 | 1.9 | 1.9 | 1.8 | 2.3 | 2.1 |
| 0.3 | 1.9 | 2 | 1.9 | 2.3 | 2 |
| 0.4 | 2 | 2 | 1.9 | 2.3 | 2.1 |
| 0.5 | 2 | 1.96 | 2.1 | 2.4 | 2.2 |
| 0.6 | 2 | 2 | 2.1 | 2.4 | 2.1 |
| 0.7 | 2.1 | 2.1 | 2.1 | 2.4 | 2.2 |
| 0.8 | 2 | 2.1 | 2.2 | 2.4 | 2.2 |
| 0.9 | 2.1 | 2.1 | 2.2 | 2.4 | 2.3 |
| 1 | 2.1 | 2.2 | 2.2 | 2.4 | 2.3 |

Table 2 describes the average resistance over five cycles of a five different samples. Each sample, except for number five, reached its peak resistance at 100% strain. The highest increase was 22.2% in sample 3, but the average increase was less than 15% excluding sample 5. This highly unexpected result is likely because as the stretchy fabric is stretched, more metal coated fibers can make connections with adjoining fibers, negating the geometrical changes which would typically increase resistance.

In the preferred embodiment the conductive composite has a fabric which is preferentially plated with silver in a predetermined design by an autocatalytic electrolysis plating process which creates a conductive material. A protective mat, in the desired predetermined design, is placed over the metalized fabric and the unwanted metal is chemically etched from the fabric. One additional method of making the embodiment is by using a protective sheet of polymer with the desired pattern cut out which is placed on top of the fabric. The sheet protects the portions of the fabric where metal deposition is unwanted from having metal deposited during the deposition process. Other methods of protecting the fabric include using a protective coating, paper sheet, hand stamping the metal on the fabric or similar means can be used. Stretchy fabrics can be used and are herein defined as any fabric that can be stretched in any direction in any amount.

Use of composites may not be appropriate in all cases. Simple conductive materials may work in some cases, however, composites are the preferred embodiment. To create a piece of the composite conductive material using conductive composites, a piece of metal coated stretchy fabric is placed on a flat glass surface ensuring that there are no stray fibers and that the fabric piece is smooth. Place bleeder and breather fabric on top of the fabric. Then place the entire system in a high temperature vacuum bag with a vacuum valve stem on one end and a second valve on the other end. Connect one end of a tube to the second valve the other end to a vat of resin. Apply a vacuum thoroughly, ensuring that there are no leaks, such that resin in drawn from the vat through the fabric. Take care to ensure the entire fabric is soaked with resin, the fabric remains flat, and no air bubbles form. This creates the resin matrix. Once the part is soaked with resin, cure the composite part with the following cycle: 1) A one-hour linear ramp to 75° C. in an oven, autoclave, or other form of controlled heating device; 2) A three-hour hold at 75° C.; 3) A three-hour linear ramp to 90° C.; 4) A two-hour linear ramp to 110° C.; 5) A one hour linear ramp to 20° C. After curing, remove the sheet from oven and allow it to cool to room temperature. Remove vacuum bag, bleeder fabric, breather fabric, and glass plates from composite. Alternatively the part may be cured at room temperature for approximately twenty-four hours to ensure a full cure of the resin with a glass plate on top to ensure the part remains flat. Once the part is cured, it can be removed from the bag for use as a conductive composite. The preferred embodiment uses one layer of metal coated stretchy fabric. It will be appreciated that more than one layer of fabric reinforcement can be used and will affect the final conductivity of the material.

In the preferred embodiment, the core enables the conductive composite material to conform to the shape of a void in which it is placed. The core is made from any deformable material to include high temperature foam, syntactic foam, general cushion foam, memory foam, expanding foam, polymer, SMP, microspheres, a composite or any other lightweight formable substance. The term deformable means the ability to alter its shape; for example to be compressible, expandable, stretchable, or shrinkable. The conductive composite material is attached to the core by an adhesive, sewing, staples, knitting, tape, pins or hook and loop fasteners. The conductive composite material can be sewn, stapled, knitted, taped, pinned or fastened by hook and loop fasteners into a desired shape and the compressive core then inserted into that shape forming a friction fit between the conductive composite material and the compressible core.

The compressible core is instrumental in ensuring contact pressure between the conductive composite material and the void's inner walls. Wrinkling and gaps will decrease the amount of heat transferred to the walls of the void and decrease the effectiveness of the heater. Wrinkling may also create short circuits in the conductive material that will change the materials resistance and may cause a failure of the heater. To ensure complete contact between the void's walls and the conductive composite material, the compressive core and conductive composite material should be formed into the shape of the void while in their uncompressed state. The compressible core should mimic the void shape and be formed to be noticeably larger than the void it will fill. The conductive composite material should also be formed in the shape of the void and should also be larger than the void. By mimicking the shape of the void, the conformal heater will fill-in acute or obtuse angles and prevent wrinkling of the conductive material when filling the void. This will ensure a fit with full contact between surfaces and that the friction between the surfaces of the void and the conformal heater can be used, if desired, to keep the heater in place. The heater is assembled as outlined above.

In the preferred embodiment, the conductive material is connected to a power source via electrical wires. The first end of the wire is connected to the conductive material via an electrically conductive connection such as welding, soldering conductive epoxy or a non-conductive resin or adhesive. The second end with the connector is connected to a power source to power the conductive material for operation of the heater.

Figure 2:
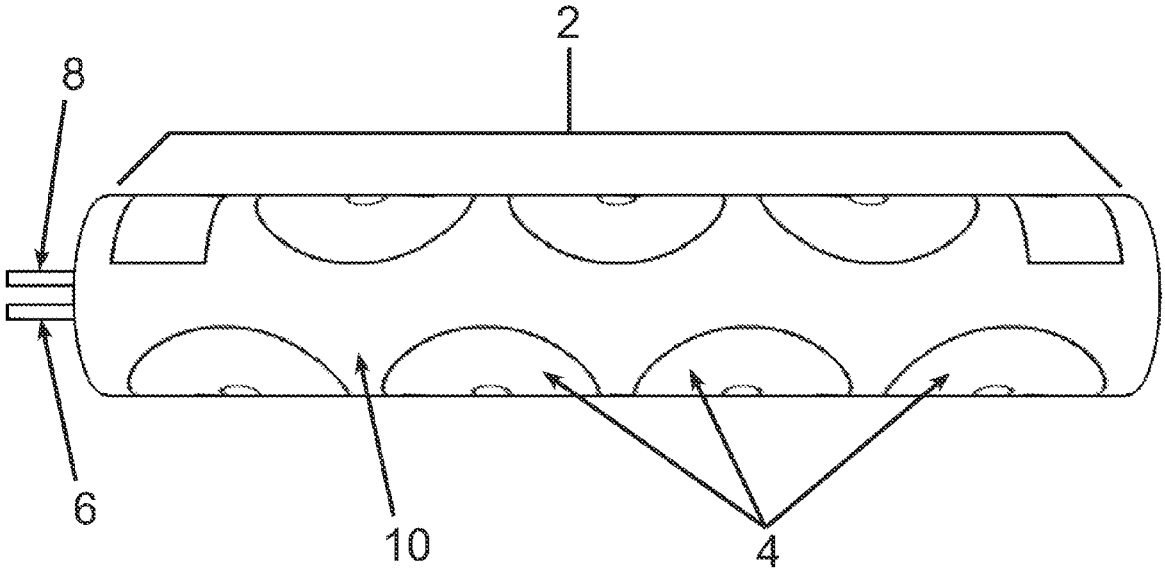
FIG. 2 shows a perspective view of the conformal heater from FIG. 1 rotated 90 degrees to further show the conductive material pattern.
Figure 3:
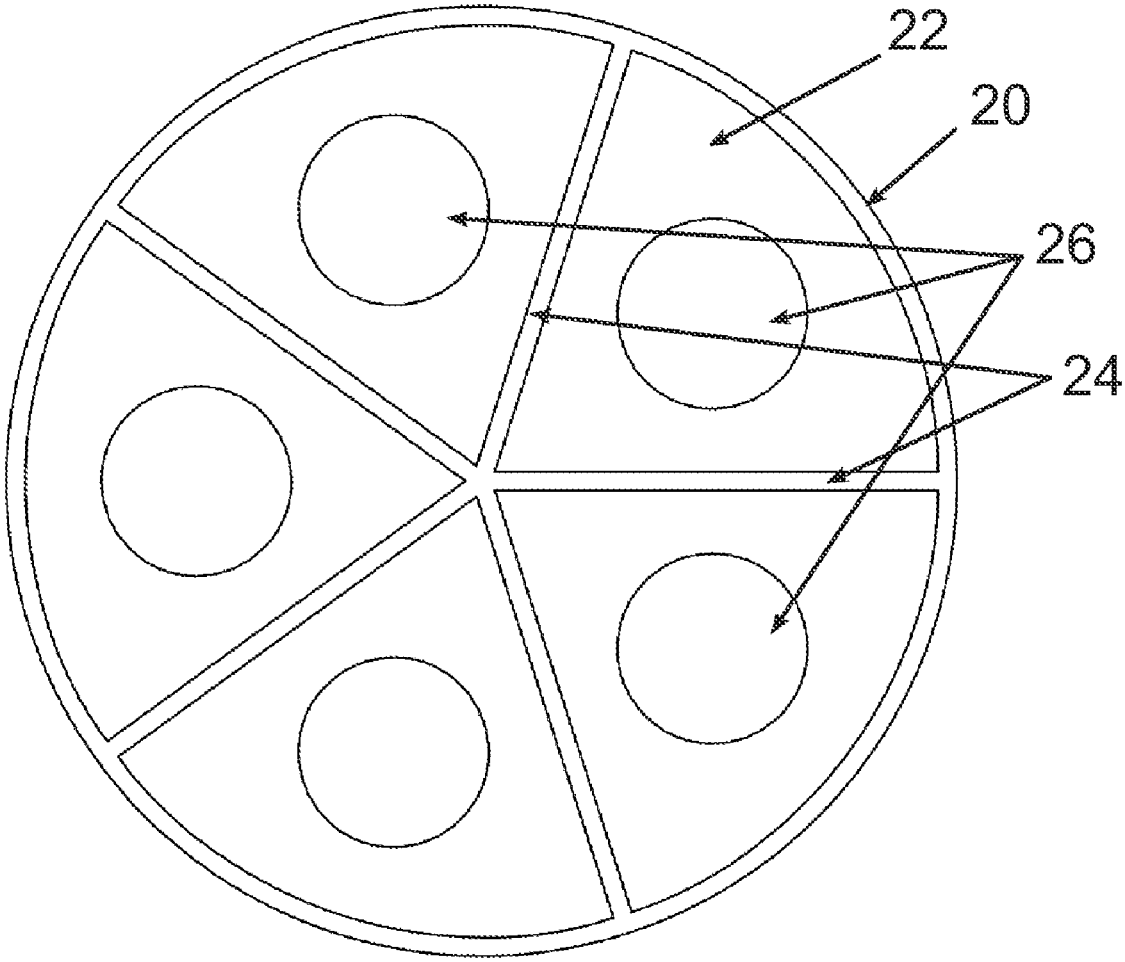
FIG. 3 shows a top view of compressed conformal heaters within pie shaped voids.
Figure 4:
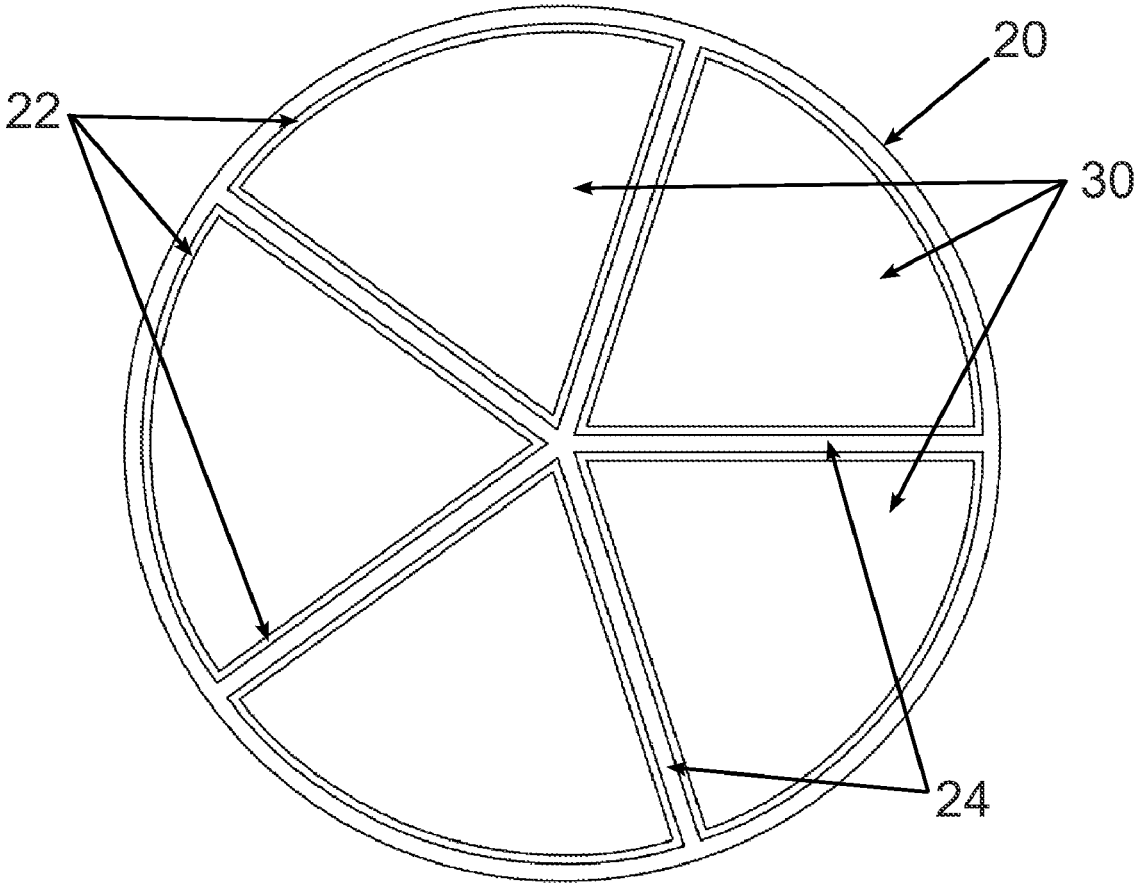
FIG. 4 shows a top view of a pie shaped voids with expanded conformal heaters conforming to the walls of the voids.
Figure 5:
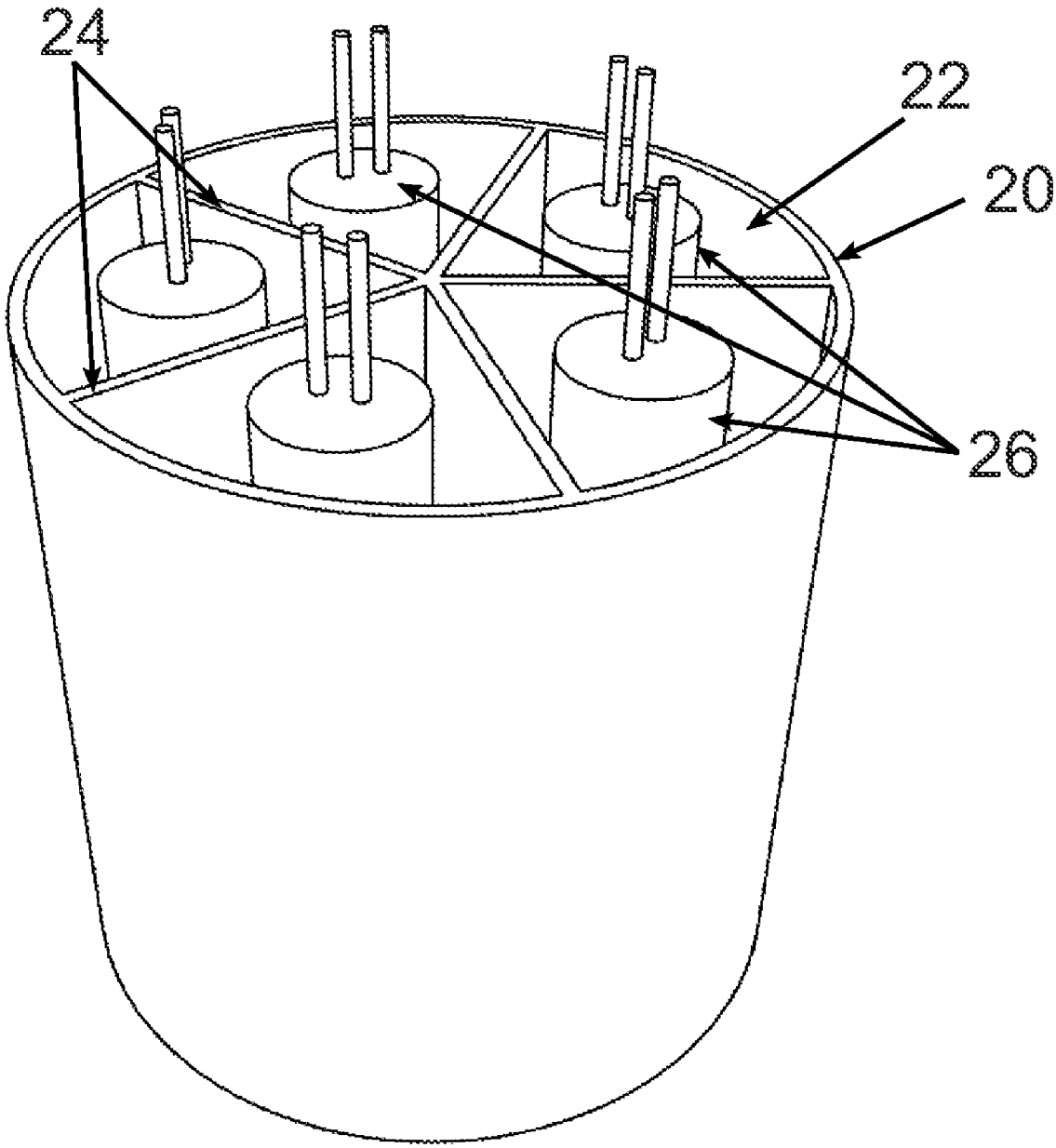
FIG. 5 shows a perspective view of compressed conformal heaters within pie shaped voids.
Figure 6:
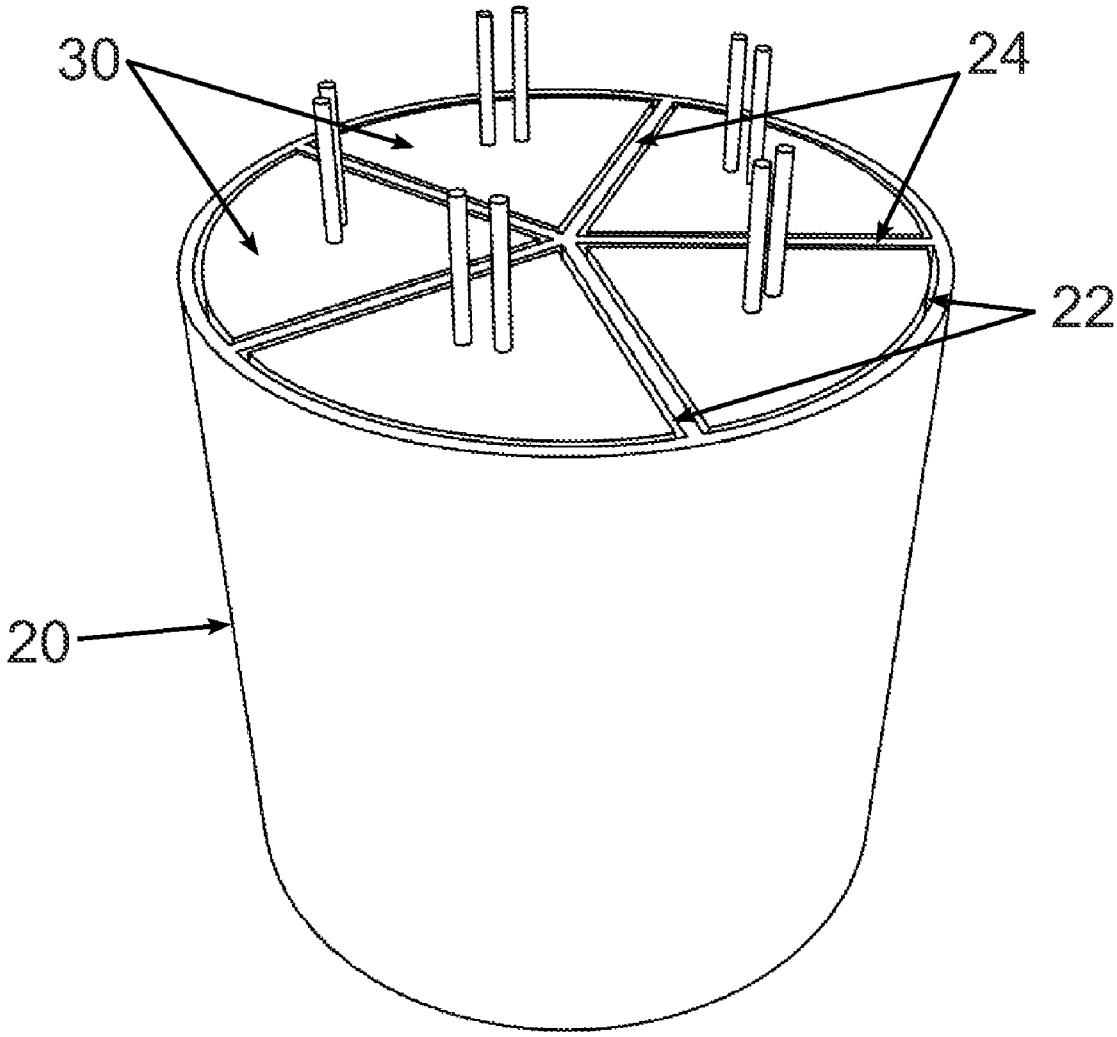
FIG. 6 shows a perspective view of pie shaped voids with expanded conformal heaters conforming to the walls of the voids.

FIG. 1 shows a conformal heater (2), with a deformable core, fibrous fabric (10), conductive composite pattern (4), a positive polarity wire (8), and a negative polarity wire (6). FIG. 2 shows the conformal heater (2) of FIG. 1 rotated 90 degrees to highlight the rest of the conductive composite pattern (4), fibrous fabric (10), a positive polarity wire (8), and a negative polarity wire (6). FIG. 3 shows compressed conformal heaters (26) inserted into a pie shaped void (22), inner walls (24), and an outer shell (20). FIG. 4 shows the conformal heaters (30) expanded and conforming to the shape of the pie shaped void (22) with surface contact with the inner walls (24) and the outer shell (20). FIG. 5 shows FIG. 3 in a perspective view with the compressed conformal heaters (26) inserted into a pie shaped void (22), inner walls (24), and an outer shell (20). FIG. 6 shows FIG. 4 in a perspective view with the conformal heaters (30) expanded and conforming to the shape of the pie shaped void (22) with surface contact with the inner walls (24) and the outer shell (20).

The conformal heater has many uses, one of which is to heat the interior walls of a void. The conformal heater can be inserted into a void either by hand or by using SMPs which will react to a stimulus to fill the void. By hand, the conformal heater is compressed, held in the compressed state and inserted into the void. When the compressed conformal heater is released, the heater expands to conform to the shape of the void. Power is applied to the heater, heating the walls of the void. Using SMPs, the conformal heater is heated either by external heat or by applying power to the conductive composite pattern. Once the SMP resin matrix is above its $T_g$ and activated, the heater is compressed to a shape smaller than the void and allowed to cool and deactivate. Once below its $T_g$, the conformal heater is held in its deformed shape. The conformal heater can be inserted into a void and held there indefinitely until activated. Once activated either by an external heat source or by applying power to the conductive composite pattern, the SMP will revert to its memory shape, conforming to the void's shape.

Depending upon the makeup of the conformal heater, the heater can change its shape in response to any number of stimuli to include thermal, mechanical pressure or air pressure or no stimuli for a non-composite heater. An air bladder for a core will allow air pressure to change the shape of the conformal heater to the void's shape. SMPs as explained above use thermal stimuli to change the shape of the conformal heater. There are a number of configurations of the heater core that can enable the conformal heater to utilize available sources of activation to conform to a void's shape.

The conformal heater can also be integral to a moving part. The fibrous fabric can be contained within a resin matrix surrounding a deformable core. That resin matrix can be a SMP or elastomer. The SMP is activated and the conformal heater is deformed. Once the SMP is deactivated, it retains that shape. If the deformed shape is a compressed shaped, then the compressed conformal heater can be inserted into a void. Whether a compressed shape or not, when power is applied to the conformal heater, the conductive material heats up the SMP and activates it. Once activated, the SMP returns to its memory shape or depending upon the core makeup, the core could exert a force to overcome the SMP strain and return to the core's resting state, further deforming the SMP. Once the heater is turned off, the SMP will deactivate. When the heater is deactivated, the entire composite can behave like a brake, preventing movement of the parent component.

If a conductive composite is used and is inserted into a moveable part, a buffering layer may be required depending upon the materials used in the conformal heater and the moveable parts. In this embodiment friction may not be desirable and a Teflon® sheet or other fabric with low thermal and friction resistance would be ideal for allowing the parts to move, allowing the conformal heater to conform to a new shape, promote slipping, and maintain a separation between the conformal heater and moving parts. The Teflon® sheet or low thermal and friction resistance fabric should be formed to mimic the shape of the conformal heater and not impede or constrict its movement.

What is claimed is:

1. A conformal heater comprising:

a deformable core; and a deformable heater wherein the combination of the deformable core and said deformable heater creates the conformal heater.

2. The conformal heater of claim 1 wherein said deformable heater is at least one layer of a fibrous material whereupon a pattern or design of electrically conductive material is etched, imprinted, embossed, stamped, or deposited on or in said fibrous material; and said deformable heater is wrapped around said deformable core creating the conformal heater.

3. The conformal heater of claim 2 wherein said fibrous material is attached to said deformable core by attachment means.

4. The conformal heater of claim 3 wherein said attachment means are adhesive, friction, sewing, staples, knitting, tape, pins, or hook and loop fasteners.

5. The conformal heater of claim 2 wherein said fibrous material is contained in a resin matrix.

6. The conformal heater of claim 5 wherein said resin matrix is a shape memory polymer or elastomer.

7. The conformal heater of claim 6 wherein said shape memory polymer or elastomer is a styrene shape memory polymer or elastomer, cyanate ester shape memory polymer or elastomer, maleimide shape memory polymer or elastomer, epoxy shape memory polymer or elastomer, acrylate shape memory polymer or elastomer, polyurethane shape memory polymer or elastomer, or vinyl ester shape memory polymer or elastomer.

8. The conformal heater of claim 1 wherein said deformable heater is comprised of at least one strip, wire, band, or ribbon of electrically conductive material is imprinted, deposited, etched, stamped, or embossed directly on said deformable core creating the conformal heater.

9. The conformal heater of claim 1 wherein said deformable core will change its shape in response to thermal stimuli, mechanical pressure, or air pressure.

10. The conformal heater of claim 1 wherein said deformable core is foam, polymer, shape memory polymer, microspheres, expanding foam, or a composite.

11. The conformal heater of claim 10 wherein said foam is a high temperature foam, syntactic foam, general cushion foam, or memory foam.

12. The conformal heater of claim 1 wherein said conformal heater has electrical wires connecting said conformal heater containing an electrically conductive material to a power source.

13. The conformal heater of claim 12 wherein said electrical wires are attached to said electrically conductive material by an electrically conductive connection.

14. A method for filling a void comprising:

a deformable core;

a deformable heater wherein the combination of the deformable core and said deformable heater creates a conformal heater;

said conformal heater is deformed, forming a deformed conformal heater;

said deformed conformal heater is inserted into the void;

said deformed conformal heater is allowed to conform to the shape of the void.

15. The method of claim 14 wherein said deformable core is foam, polymer, shape memory polymer, microspheres, expanding foam, or a composite.

16. The method of claim 15 wherein said foam is a high temperature foam, syntactic foam, general cushion foam, or memory foam.

17. The method of claim 14 wherein said deformable heater is at least one layer of a fibrous material wherein a pattern or design of conductive material is etched, imprinted, embossed, stamped, or deposited on or in said fibrous material;

said deformable heater is wrapped around said deformable core creating the conformal heater.

18. The method of claim 17 wherein said fibrous material is attached to said deformable core by attachment means.

19. The method of claim 18 wherein said attachment means are adhesive, sewing, staples, knitting, tape, pins, or hook and loop fasteners.

20. The method of claim 17 wherein said fibrous material is formed into a shape and said deformable core is inserted within said shape.

21. The method of claim 17 wherein said fibrous material is contained in a resin matrix.

22. The method of claim 21 wherein said resin matrix is a shape memory polymer or elastomer.

23. The method of claim 22 wherein said shape memory polymer or elastomer is a styrene shape memory polymer or elastomer, cyanate ester shape memory polymer or elastomer, maleimide shape memory polymer or elastomer, epoxy shape memory polymer or elastomer, acrylate shape memory polymer or elastomer, polyurethane shape memory polymer or elastomer, or vinyl ester shape memory polymer or elastomer.

24. The method of claim 21 wherein said conformal heater is activated, said conformal heater is deformed to form a deformed compressed conformal heater, said deformed conformal heater is deactivated, said deformed conformal heater is inserted into the void; and said deformed conformal heater is activated to allow said deformed conformal heater to conform to the shape of the void.

25. The method of claim 14 wherein said conformal heater has electrical wires connecting said conformal heater to a power source.

26. The method of claim 25 wherein said electrical wires are attached to a conductive material by an electrically conductive connection.

27. The method of claim 14 wherein said conformal heater will change its shape in response to thermal stimuli or mechanical pressure or air pressure.

28. The method of claim 14 wherein said deformable heater is comprised of at least one strip, wire, band, or ribbon of electrically conductive material is imprinted, deposited, etched, stamped, or embossed directly on said deformable core creating the conformal heater.

* * * * *